US006824244B2

(12) United States Patent
Koguchi

(10) Patent No.: US 6,824,244 B2
(45) Date of Patent: Nov. 30, 2004

(54) MULTI-CHANNEL RECORDING HEAD, IMAGE RECORDING METHOD AND IMAGE RECORDING APPARATUS

(75) Inventor: Hideyuki Koguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/608,531

(22) Filed: Jun. 30, 2003

(65) Prior Publication Data

US 2004/0017425 A1 Jan. 29, 2004

(30) Foreign Application Priority Data

Jul. 1, 2002 (JP) ..... 2002-191726

(51) Int. Cl.[7] ..... B41J 2/145; B41J 2/15; B41J 29/393

(52) U.S. Cl. ..... 347/40; 347/19

(58) Field of Search ..... 347/40, 41, 37, 347/19

(56) References Cited

U.S. PATENT DOCUMENTS 4,051,538 A 9/1977 Fox et al.
5,640,183 A * 6/1997 Hackleman ..... 347/40
6,252,622 B1 6/2001 Laberge
6,450,613 B1 * 9/2002 Rietbergen ..... 347/41
2002/0057307 A1 5/2002 Wen et al.

* cited by examiner

*Primary Examiner*—Thinh Nguyen
(74) *Attorney, Agent, or Firm*—Sughrue Mion, PLLC

(57) ABSTRACT

The multi-channel recording head includes a plurality of recording channels arranged in one direction, and spare channels arranged away from the recording channels by an integral multiple of the channel pitch of the recording channels on the extension of an array of the recording channels. The spare channels are arranged as least as many as the number of the recording channels, and each spare channel has the same physical resolution as the resolution of an image to be recorded. The physical resolution of the multi-channel recording head is lower than the resolution of the image. The image recording method and the image recording apparatus record the image by using the above multi-channel recording head.

11 Claims, 6 Drawing Sheets

MULTI-CHANNEL RECORDING HEAD, IMAGE RECORDING METHOD AND IMAGE RECORDING APPARATUS

BACKGROUND OF THE INVENTION

This invention belongs to a technical field of interleave recording where a multi-channel recording head is used to perform image recording in a higher resolution than the physical resolution of a recording head, and in particular relates to a multi-channel recording head which is capable of performing image recording as usual without causing a drop in the productivity even in case the recording head includes a faulty channel, an recording method using this recording head and an image recording apparatus which executes this image recording method.

A multi-channel recording head having a plurality of recording channels (recording elements) has been used in a variety of printers, such as a multi-channel exposure head which uses a plurality of light beams to expose a photosensitive material to light and an ink-jet recording head where a plurality of nozzles for discharging ink droplets are arranged.

As one of the image recording methods using such a multi-channel recording head (hereinafter simply referred to as a recording head), a so-called image recording method by way of a drum scanner is known where a recording medium such as a photosensitive material or image receiving paper is wrapped around the periphery of a drum to fix itself onto the drum, and by moving a recording head in the direction of the axis of a drum (sub-scanning) while rotating the drum (main scanning) and having the direction of the recording channel array on the recording head aligned with the direction of the axis of the drum, the recording material is scanned two-dimensionally.

In image recording by way of a drum scanner using such a recording head, the interleave (image) recording is known where images are recorded by driving each recording channel so as to bridge the gaps between adjacent recording channels in accordance with the travel amount of the recording head in the direction of the axis of the drum thereby performing image recording at a higher resolution than that of the recording head (physical resolution of the recording head).

As an example of interleave recording by way of a multi-channel recording head, a recording method shown in FIG. 6 is known.

The example shown performs image recording at 600 dpi by using a recording head having four channels (circles with solid lines in the figure) whose resolution is 150 epi (ejection per inch). In this image recording method, four-fold image recording is made with interleave recording. For each rotation of the drum, the recording head moves, by one quarter of its channel pitch, in the direction of the axis (array of recording channels) shown by an arrow to record an image.

With four rotations of the drum in the image recording, that is, four times of image recording, the respective gaps between recording channels are filled with three recording pixels. This provides image recording at 600 dpi.

In this recording method, in order to perform recording in the downstream of the pixels already recorded, that is, in the travel direction of the recording head, the recording head is moved before recording with the fifth rotation in one stroke until the recording channel extremely upstream is 600 dpi away from the recording position of the recording channel extremely downstream at the end of the fourth rotation, as shown by an arrow m. Next, recording for four rotations of the drum is performed similarly. Then, the recording head is moved in one stroke to perform the next recording. This procedure is repeated to record an image at 600 dpi on the entire surface of a recording medium by using a four-channel recording head whose resolution is 150 epi.

However, such a recording method (step-scan) has a problem that a recording head must be moved by a substantial amount per predetermined number of drum rotations to correspond to an improved resolution by interleave recording and this tends to result in uneven image recording.

Interleave recording to solve this problem is also known which employs a so-called helical scanning while rotating a drum and continuously moving a recording head at a constant speed to record an image on the entire surface of a recording medium. In this method, image recording is performed where the ratio of travel amount of the recording head per rotation of the drum to the channel pitch (1 pitch) of the recording channel is assumed as p, the ratio of the recording resolution to the physical resolution of the recording head as N, the number of recording channels as M, and an arbitrary integer as X, N and M being integers and the following expressions (1) and (2) are satisfied (detailed later):

$$p^{*}N=M \qquad \text{Expression (1)}$$

$$p=X+1/N \qquad \text{Expression (2)}$$

FIG. 7 shows an example of the recording method.

The example shown in FIG. 7 performs image recording at 600 dpi by using a recording head having five recording channels whose resolution is 150 epi each. In this example, the recording head is continuously moved at a ratio of 1.25 to the pitch of the recording channel per rotation of the drum to perform image recording with each recording channel.

In this way, as shown in FIG. 7, on and after the fourth rotation (from the midst of the third rotation), each gap between recording channels is filled with three recording pixels. This provides image recording at 600 dpi by using a recording head having a resolution of 150 epi.

In the interleave recording using this recording head, when a channel goes faulty (defective), a line-shaped whiteness clarity or streaked unevenness appears on the recorded image, an image of a proper quality cannot be recorded.

In order to prevent such an inconvenience, various methods have been proposed.

One of the methods is to group odd-numbered channels of a recording head and even-numbered channels of the recording head, and in case a faulty channel is detected, the recording channels of a group which does not contain the faulty channel are used to record an image.

In the method, however, the resolution of the resulting recorded image after a channel has gone faulty is reduced to half the normal resolution. To record an image in the same resolution as that before a channel has gone faulty, the productivity is reduced by half.

Another method is known where the array of recording channels is split into two arrays at the faulty channel. The array which has the larger number of channels is used to perform image recording.

In this method, the number of channels of the recording head differs in accordance with the location of the faulty channel, so that the productivity differs case by case. Moreover, image processing such as assignment of image data is complicated thus resulting in higher system costs.

A method is also known where two recording heads are used or a spare channel same as a recording channel is used.

In this method, the cost of the recording head is nearly doubled. A room where the spare head is to be arranged is required. Further, the size of the recording head is doubled. These disadvantages limit the freedom of apparatus design and prevents downsizing of the apparatus.

SUMMARY OF THE INVENTION

The object of the invention is to solve the problems of the related art and to provide a multi-channel recording head which is capable of performing image recording without lowering the productivity and resolution in a short halt period and low cost even in the presence of a faulty channel in the interleave recording to provide image recording at a higher resolution than the physical resolution of a recording head, by employing a drum scanner using a multi-channel recording head thus filling the gaps between recording channels with pixels in image recording, and which is capable of preventing reduction of an yield due to the faulty channel, an image recording method using the recording head, and an image recording apparatus which executes this image recording method.

In order to attain the object described above, the present invention provides a multi-channel recording head the physical resolution of which is lower than the resolution of an image to be recorded, comprising: a plurality of recording channels arranged in one direction; and spare channels arranged away from said recording channels by an integral multiple of the channel pitch of said recording channels on the extension of an array of said recording channels, said spare channels being arranged as least as many as the number of said recording channels, and each spare channel having the same physical resolution as the resolution of said image to be recorded.

Preferably, said resolution of said image to be recorded is the dot resolution of said image to be recorded.

Preferably, said spare channels are arranged on both ends of the array of said recording channels.

In order to attain the object described above, the present invention provides an image recording method of recording an image by using the recording head described above, said image recording method comprising: rotating a drum with a recording medium wrapped around the periphery of the drum; moving said recording head in a direction of an axis of the drum while aligning a direction of the array of said recording channels of said recording head with the direction of the axis of the drum; and modulating each recording channel of said recording head in accordance with said image to be recorded, thereby performing image recording at a higher resolution than said physical resolution of said recording head, when a faulty channel exists among said recording channels, said image recording method further comprising: previously determining a spare channel corresponding to the faulty channel among said recording channels; assigning recording data on said fault channel to the corresponding spare channel in the image recording; and modulating said corresponding spare channel with said assigned recording data in accordance with the number of rotations of said corresponding spare channel behind said faulty channel in the image recording.

In order to attain the object described above, the present invention provides an image recording apparatus, comprising: the recording head described above; a drum rotating with a recording medium wrapped around the periphery of the drum; moving means for moving said recording head in the direction of the axis while aligning the direction of the array of the recording channels of said recording head with the direction of the axis of the drum; determining means for acquiring the information on a faulty channel of said recording head and determining a spare channel corresponding to the faulty channel; and modulating means for modulating each recording channel of said recording head in accordance with the rotation of said drum and travel of said recording head, and when the faulty channel exists among said recording channels, assigning the recording data on said fault channel to the corresponding spare channel, and modulating said spare channel with said assigned recording data in accordance with the number of rotations of the spare channel behind the faulty channel, thereby performing image recording at a higher resolution than the physical resolution of said recording channel.

In the image recording method and the image recording apparatus of the present invention, the ratio of travel amount of the recording head per rotation of said drum to the channel pitch of said recording channel is assumed as p, the ratio of the recording resolution to the physical resolution of said recording head as N, the number of recording channels of said recording head as M, and an arbitrary integer as X, N and M being integers and the following expressions (1) and (2) are satisfied:

$$p*N=M \quad \text{Expression (1)}$$

$$p=X+1/N \quad \text{Expression (2)}$$

DETAILED DESCRIPTION OF THE INVENTION

The recording head, image recording method, and image recording apparatus according to the invention will be detailed based on the preferable embodiments shown in the attached drawings.

The following is an example where this invention is applied to an ink-jet printer (ink-jet recording head). Note that the invention is not limited thereto but may be applied to a variety of multi-channel recording heads such as a multi-channel exposure head which is capable of individually modulating a plurality of light beams to perform exposure of a photosensitive material, thermal recording head or dot impact recording head. The invention may be also applied to interleave recording using such a multi-channel recording head.

In particular, the invention is preferable for an ink-jet printer, which allows easy preparation of a spare channel described later and is more likely to encounter a faulty channel.

Figure 1:
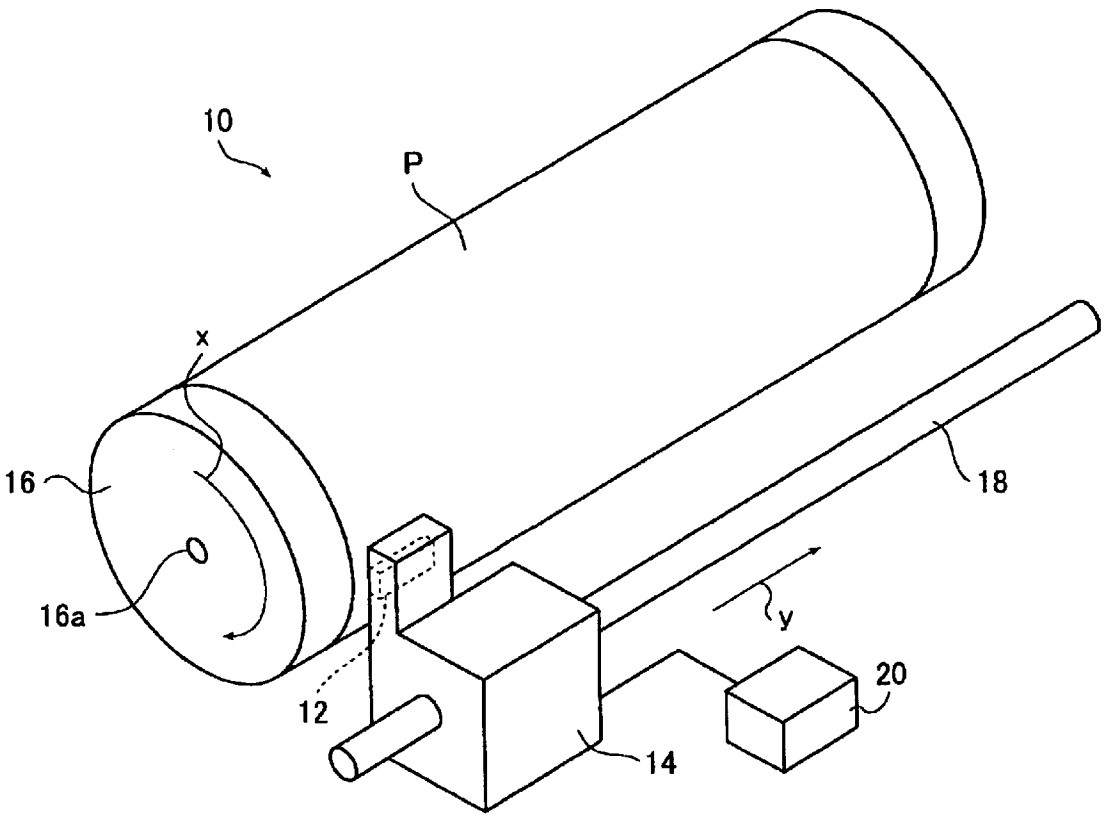
FIG. 1 is a general perspective view of an example of an image recording apparatus according to the invention.

FIG. 1 is a conceptual illustration of an example of an image recording apparatus which uses a recording head according to the invention to execute the image recording method according to the invention.

An ink-jet printer 10 (hereinafter referred to as the printer 10) shown in FIG. 1 basically comprises a head unit 14 to which the recording head 12 of the ink-jet is attached, a drum 16, means for moving the head unit 14 (not shown), and setting means 20.

The printer 10 is a so-called drum scanner where an image receiving medium P is wrapped around the periphery of the drum 16 and by rotating the drum 16 about a central axis 16*a* in the direction of an arrow x and, aligning the direction of the array of recording channels of the recording head 12 with the direction of the extension of the central axis 16*a* (axis of the drum 16), and continuously moving the head unit 14 in the axis direction (direction of an arrow y in the figure), the image receiving medium P is two-dimensionally scanned through helical scanning by way of the recording channels arranged on the recording head 12 thus recording an image on the entire surface of the image receiving medium P.

The printer 10 shown performs interleave recording where image recording is made to fill the gaps between the recording channels of the recording head 12 in image recording by way of a drum scanner using the multi-channel recording head 12, thereby performing image recording at a higher resolution than that of the recording head 12 (physical resolution of the recording head 12). The image recording will be detailed later.

The head unit 14 is basically the same as the head unit, such as the ink-jet cartridge, of a known ink-jet printer. The head unit 14 comprises, in addition to the recording head 12, an ink tank, a supply path for feeding ink to the recording head 12, means for supplying a driving energy to the recording head 12, and recording control means for driving the recording head in accordance with image data. The head unit 14 is arranged so as to have the direction of discharge of ink from the recording head 12 face to the drum 16.

To the head unit 14 is connected setting means 20 which assigns image data to each recording channel in accordance with the interleave recording described later, determines a spare channel corresponding to a faulty channel in accordance with the supplied information on the faulty channel of the recording head 12, rearranges pixels in accordance with the number of rotations of the spare channel keeps behind the faulty channel, assigns the image data of the faulty channel to the spare channel, and transmits the image data to the recording control means.

The recording head 12 is a known multi-channel ink-jet recording head basically comprising, in addition to a spare channel described later for compensating for a faulty channel, nozzles for discharging ink, actuator as ink discharge means, an ink supply path for supplying ink to each nozzle, and a driver for the actuator.

The recording head 12 may be used as a recording head in various types of ink-jet. Thus, the recording head 12 may be used in a so-called thermal ink-jet printer which heats ink with a heater as an actuator and discharges ink by way of growth of bubbles, a so-called piezoelectric-type ink-jet printer which vibrates a diaphragm to discharge ink by way of an actuator using a piezoelectric element, or an electrostatic-type ink-jet printer which vibrates a diaphragm to discharge ink by way of MEMS (Micro Electronic Mechanical System) using static electricity.

The recording head 12 may be used in a top-shooter-type ink-jet printer (face ink-jet printer) which discharges ink in vertical direction with respect to a substrate surface or a side-shooter-type ink-jet printer (edge ink-jet printer) which discharges ink in parallel direction with respect to a substrate surface.

The recording head 12 may be a color recording head which discharges inks of C (cyan), M (magenta), Y (yellow) and K (black), or a monochrome recording head which discharges only K ink. The invention may be applied to at least one recording head in a head unit where a plurality of recording heads are arranged in a direction orthogonal to the direction of the array of recording channels, such as monochrome recording heads each of which discharges each of inks of C, M, Y and K. In a long recording head where short recording heads (short heads) are arranged in a straight line or in the staggered shape, the invention may be applied to the entire long recording head or each short head.

In the following description, a monochrome recording head is described as an example in order to simplify drawings and description thus clarifying the features of the invention.

Such a head unit 14 is indicated as freely movable in the axis direction of the drum 16 by a guide bar 18 extending in the axis direction of the drum 16 and moved in the direction of an arrow y (hereinafter referred to as the sub-scanning direction) by way of moving means not shown.

The head unit 14 (recording head 12) may be moved by any method. Various methods may be used as long as it attains the target moving accuracy, including screw transmission, belt transmission using a pulley or the like, and a method with rack-and-pinion gears and the like.

The drum 16 is an ordinary drum used in a drum scanner and is a cylinder which rotates about the central axis 16*a* while holding an image receiving medium P on its (outer) periphery by way of a known method.

In the invention, the drum is not limited to an outer drum shown but may be a so-called inner drum which holds an image receiving medium (recording medium) P on its inner periphery.

Figure 2A:
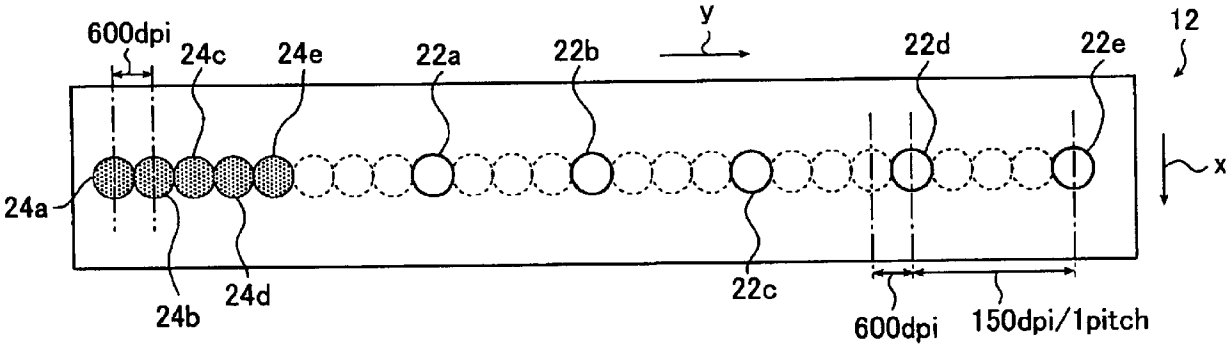
FIG. 2A is a conceptual illustration of an example of a recording head according to the invention.

FIG. 2 is a conceptual illustration of the surface (ink discharge face) of an example of the recording head 12.

The recording head 12 shown performs image recording at 600 dpi and comprises five recording channels (nozzles) 22 including the recording channels 22*a* through 22*e* whose resolution is 150 epi (ejection per inch), as the physical resolution of the recording head 12. Further, the recording head 12 comprises five spare channels 24 (24*a*–24*e*) at 600 epi, same as the recording resolution, away from the recording channels, by the channel pitch of the recording channels 22 (hereinafter assumed as 1 pitch), in the extension of an array of recording channels. As mentioned earlier, the recording head 12 is basically a recording head of a known ink-jet printer except that it comprises the spare channel 24. The spare channel 24 will be detailed later.

The interleave recording using the recording head 12 will be described.

As mentioned earlier, the printer 10 shown uses the multi-channel recording head 12 to perform interleave recording by way of helical scanning using a drum scanner with the recording head 12 whose resolution is 150 epi to thereby perform image recording in a higher 600 dpi.

As mentioned earlier, the interleave recording at an evenly and properly improved resolution is performed by setting the travel pitch p as the ratio of the travel amount of the recording head 12 in one rotation of the drum 16 with respect to the channel pitch of the recording 22 (p=[travel amount of recording head in one rotation of drum]/[1 pitch]), the resolution magnitude N as the ratio of the recording resolution with respect to the resolution of the recording head 12 (N=[recording resolution]/[physical resolution]), the number of channels M as the number of recording channels 22 of the recording head 12, and X as an arbitrary integer, N and M being integer, such that the below expressions (1) and (2) are satisfied and by filling evenly the gaps between respective recording channels 22 to perform image recording:

$$p^*N=M \quad \text{Expression (1)}$$

$$p=X+1/N \quad \text{Expression (2)}$$

Figure 3:
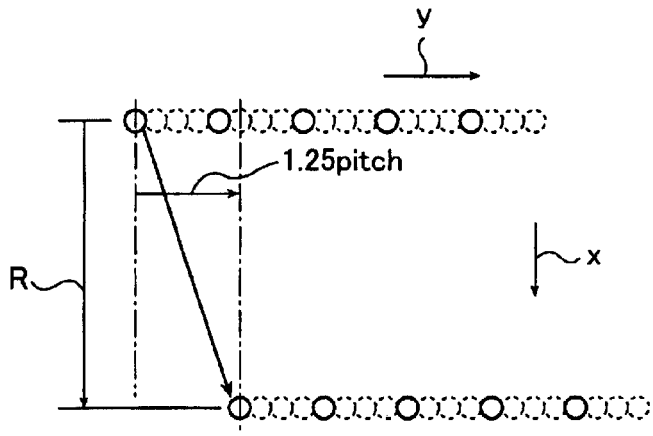
FIG. 3 is a conceptual illustration to explain image recording in FIG. 2.
Figure 6:
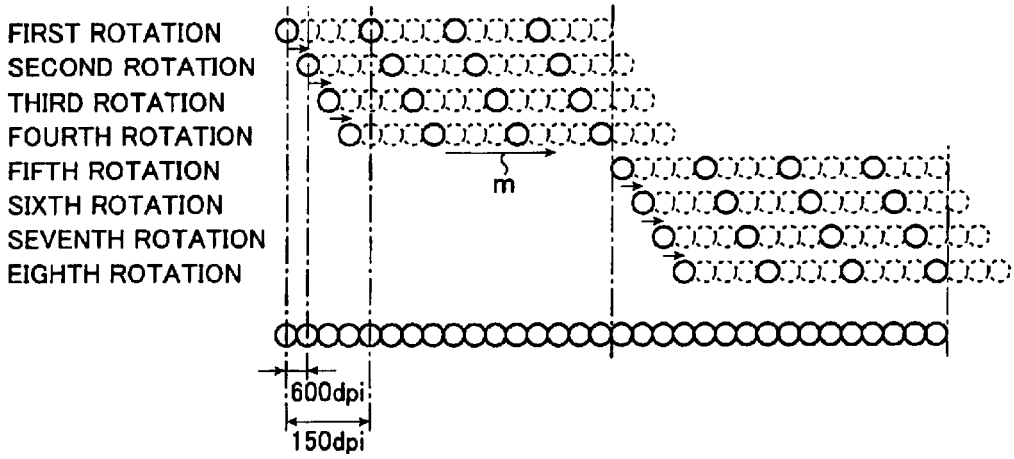
FIG. 6 is a conceptual illustration to explain an example of a related art recording method.
Figure 7:
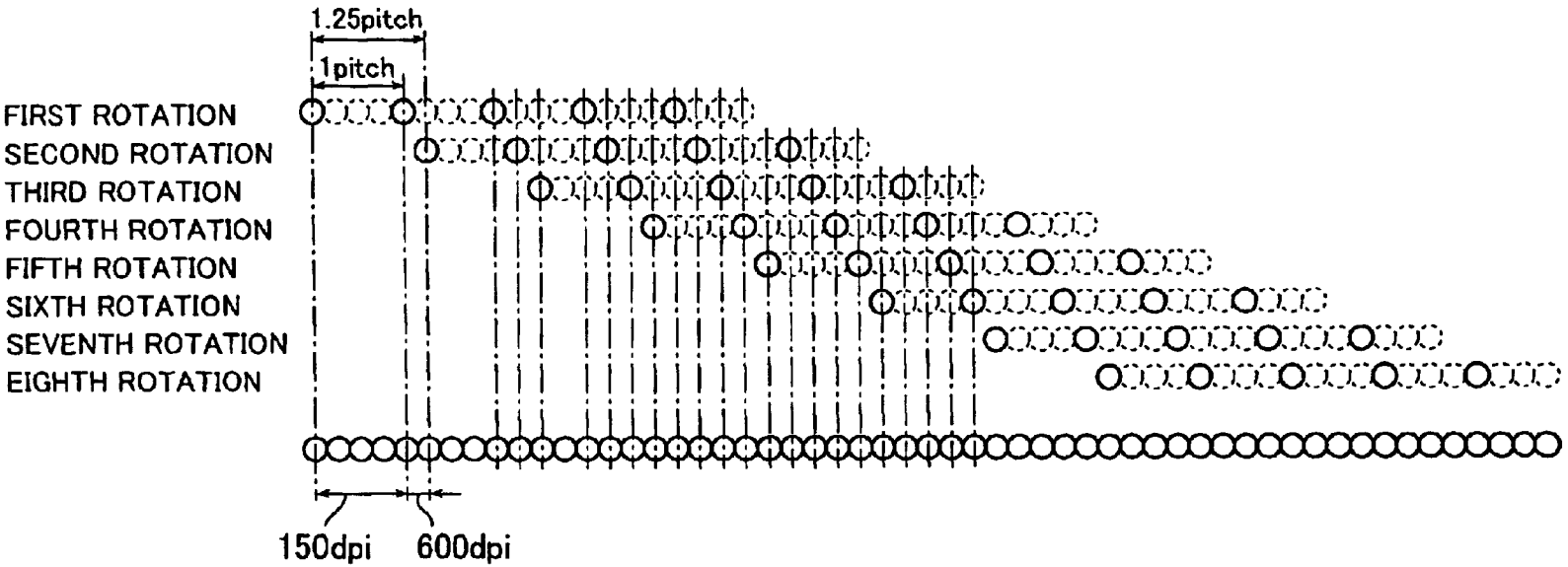
FIG. 7 is a conceptual illustration to explain another example of the related art recording method.

The example shown performs image recording at 600 dpi by using the recording head 12 having five recording channels whose resolution is 150 epi each. That is, the number of channels is 5 and the resolution magnitude N is 4. The travel pitch p is 1.25. That is, as shown conceptually in FIG. 3, the recording head 12 is moved by 1.25 times (1.25 pitch) the channel pitch of the recording channels 22 (hereinafter assumed as 1 pitch) while the drum 16 turns one rotation (arrow R). In this case, by assuming X=1, the above expressions (1) and (2) are satisfied. In other words, an integer "1" to satisfy the above expressions exists (this interleave recording is the same as that in FIG. 7 mentioned earlier).

Figure 2B:
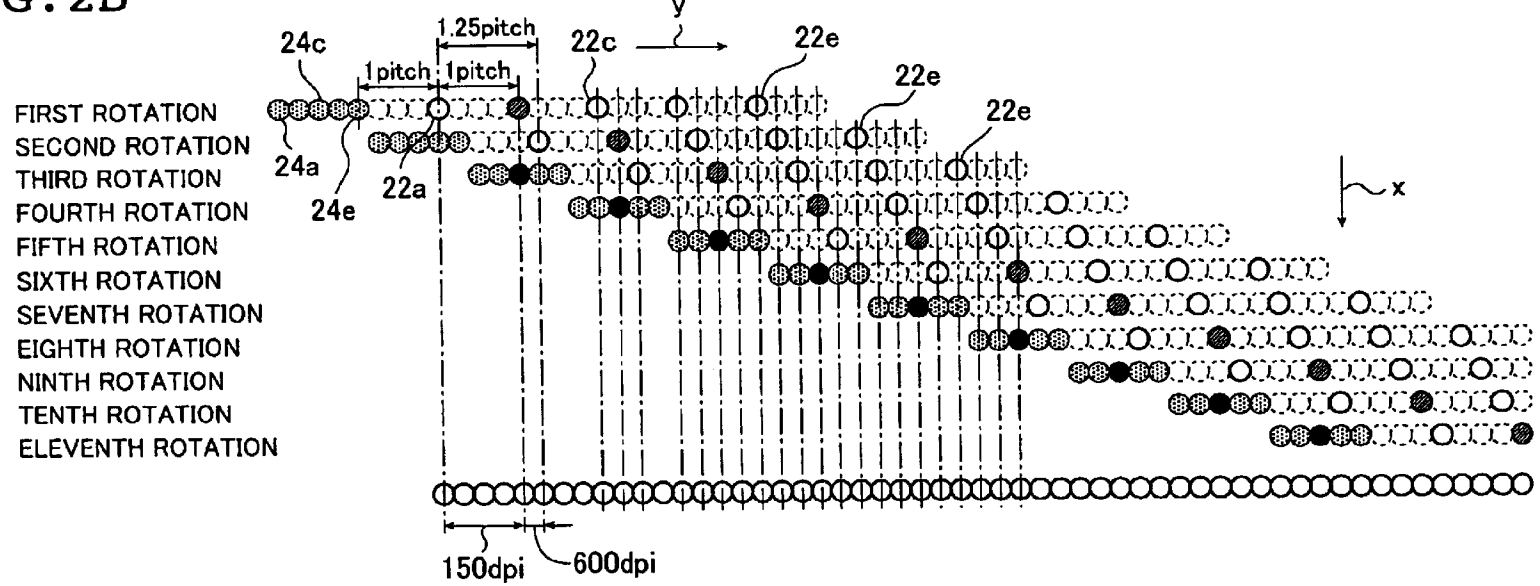
FIG. 2B is a conceptual illustration to explain interleave recording by using the recording head in FIG. 2A.

In the example shown in FIG. 2, by driving each recording channel 22 in accordance with a recorded image with the above conditions satisfied, as shown in FIG. 2B, the 1st, 5th, 9th, 13th and 17th pixels are recorded in the sub-scanning direction (direction of an arrow y) in the first rotation of the drum 16, the 6th, 10th, 14th, 18th and 22nd pixels are recorded in the second rotation, the 11th, 15th, 19th, 23rd and 27th pixels are recorded in the third rotation, the 20th, 24th, . . . in the fourth rotation, and on. On and after the 13th recording pixel in the sub-scanning direction, the gaps between the recording channels 22 are evenly filled with three recording pixels to perform image recording at 600 dpi which is higher than the resolution of the recording head 12.

In the above expressions, N represents the resolution magnitude. From a different point of view, N represents a repetition cycle (number of recordings before reaching the adjacent recording channel) in interleave recording. To perform proper recording, when the drum 22 has rotated N times, or at the start of the (N+1)th rotation, the recording channel extremely upstream (22*a* in the example shown) must be located 1 pitch downstream of the recording channel extremely downstream (22*e* in the sample shown) at the start of the recording cycle.

To arrange recording pixels at proper intervals in the direction of sub-scanning (direction of the array of recording channels), the recording head 12 must travel by an integral multiple of 1 pitch of the recording channel plus one pixel of the recording resolution.

In case such conditions satisfy the above expressions and an integer X exists in the above expressions in various combinations of the travel pitch p, number of channels M and resolution magnitude N, interleave recording is made possible.

In other words, in accordance with at least one of the predetermined target recording resolution, of the predetermined physical resolution of the recording head, and of the predetermined number of recording channels, the remaining parameters should be determined so as to satisfy the above expressions.

For example, in case image recording is performed using a recording head whose resolution is 150 epi to perform image recording at 600 dpi, assuming that the number of channels M is 17 and the travel pitch p is 4.25, X=4 exists, and proper interleave recording is made. In case M=61, setting p=15.25 (X=15) or in case M=65, setting P=16.25 (X=16) provides proper interleave recording. In case image recording is performed using a recording head whose resolution is 150 epi to perform image recording at 300 dpi, assuming that the number of channels M is 11 and the travel pitch p=5.5, X=5 exists, and proper interleave recording is made.

The recording head 12 of the invention has five spare channels 24 (24*a*–24*e*), as many as the number of recording channels, whose resolution is the same (600 epi) as the recording resolution, in a position 1 pitch away from the recording channel 22 (the outermost recording channel 22*a*) in the extension of an array of recording channels. In the invention, the number of the spare channels 24 is not limited to the same as the number of the recording channels 22 but may be the same as or greater than the number of the recording channels 22.

According to the recording head 12 of the invention, use of the spare channels 24 compensates for any faulty recording channel 22 and allows image recording at 600 dpi without reducing the productivity.

Details will be given referring to FIG. 2B.

In the example shown in FIG. 2, assume that a hatched recording channel 22*b* is a faulty channel (hereinafter referred to as the faulty channel 22*b*).

As mentioned earlier, in the first rotation of the drum 16, each recording channel of the recording head 12 records the 1st, 5th, 9th, 13th and 17th pixels in the sub-scanning direction (direction of an arrow y). However, in this example, the fifth pixel is not recorded because of a faulty channel 22*b*. Similarly, the 6th, 14th, 18th and 22nd pixels except on the faulty channel 22*b* are recorded in the second rotation. The 11th, 19th, 23rd and 27th pixels are recorded in the third rotation.

Here, as shown in FIG. 2B, in the third rotation of the drum 16, a spare channel 24*c* (solidly shaded) is positioned at the fifth pixel in the same position in the sub-scanning direction as the faulty channel 22*b* in the first rotation. The image which should have been recorded by the faulty channel 22*b* in the first rotation is recorded by the spare channel 24*c* in the third rotation, thereby compensating for the faulty channel 22*b*.

Similarly, in the fourth rotation, a spare channel 24*c* is positioned at the 10th pixel which should have been recorded by the faulty channel 22*b* in the second rotation. In the fifth rotation, the spare channel 24*c* is positioned at the 15th pixel which should have been recorded by the faulty channel 22*b* in the third rotation.

In this example, the spare channel 24*c* is positioned two rotations behind at the pixel which should have been recorded by the faulty channel 22*b*. Thus the faulty channel 22*b* is compensated for with the spare channel 24*c*.

Similarly, in case the recording channel 22*a* is a faulty channel, the spare channel 24*d* is positioned at the same pixel two rotations behind. In case the recording channel 22*c* is a faulty channel, the spare channel 24*b* is positioned at the same pixel three rotations behind. In case the recording channel 22*d* is a faulty channel, the spare channel 24*a* is positioned at the same pixel four rotations behind. In case the recording channel 22*e* is a faulty channel, the spare channel 24*e* is positioned at the same pixel four rotations behind. In any case, the faulty channel is compensated for.

Figure 4:
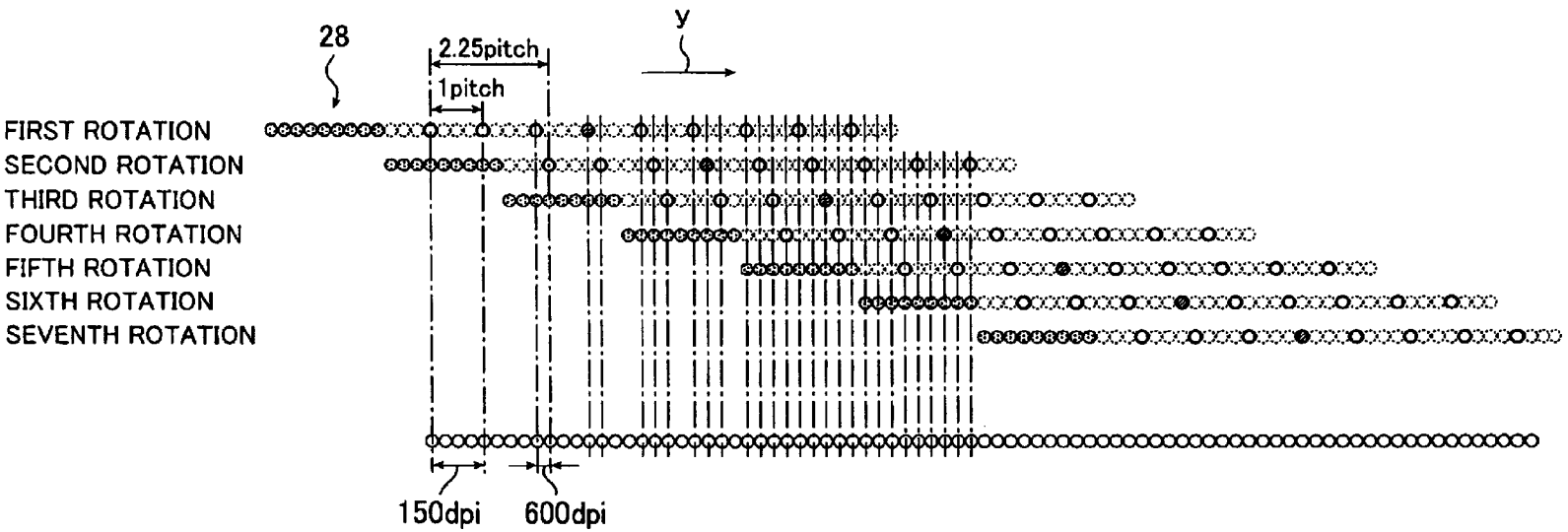
FIG. 4 is a conceptual illustration to explain another example of the invention.

FIG. 4 shows another example of the recording head having spare channels and the image recording method according to the invention.

While the example shown in FIG. 4 uses a recording head of 150 epi to perform recording at 600 dpi, same as the preceding example, the number of recording channels M of the recording head is 9 and the travel pitch p is 2.25 (X=2). In the example shown, nine spare channels 28 are arranged whose resolution is 600 dpi, the same as that of the recorded image, as many as the number of recording channels of the recording head, in a position 1 pitch away from the recording channel in the extension of an array of recording channels.

As shown in FIG. 4, in this example also, it is possible to perform proper interleave recording while filling the gaps between recording channels (circles with solid lines) with three recording pixels by satisfying the above expressions (1) and (2). For example, the fourth recording channel from left shown by hatch lines in the figure is compensated for two rotations behind with the third spare channel from right in the figure. Any recording channel can be compensated for with any one of spare channels 28. Even in the presence of a faulty channel, it is possible to perform image recording at 600 dpi without streaked unevenness such as a whiteness clarity.

According to the invention comprising spare channels whose resolution is the same as the recording resolution at least as many as the recording channels in a position away from the recording channel by an integral multiple of a channel pitch in the extension of an array of recording channels, by detecting a faulty channel and determining a corresponding spare channel and performing compensation, it is possible to perform image recording at a predetermined resolution by way of compensation for the faulty channel with the same productivity as occurrence of the faulty channel, even in the event of a damage on any of the recording channels 22 during use. In case a defective channel is found during manufacturing, that channel can be similarly compensated for. This improves the production yield.

Spare channels corresponding to the recording channels 22 and the number of rotations behind are uniquely determined by the number of recording channels of the recording head and the position of each spare channel (number of pitches from the recording channel). Only if a faulty channel is detected, the channel is immediately compensated for and the halt time is minimized.

In the invention, the position of the spare channel 24 is not limited to a position away by the channel pitch of the recording channel 22 (1 pitch) as shown. Each spare channel may be away from the recording channel (outermost channel) by an integral multiple of the channel pitch of the recording channel, such as 2 pitches or 3 pitches, as long as the number of spare channels is same as the number of recording channels and the resolution is the same.

Similar compensation for a faulty channel is allowed even in case a spare channel is away from the recording channel by the recording resolution. However, this case is not preferable because it could result in a crosstalk between the recording channel and the spare channel.

In case a plurality of channels have gone faulty and the corresponding spare channels are adjacent to each other in the foregoing examples, a crosstalk could take place during image recording by way of spare channels thus degrading the image quality.

For example, in the example shown in FIG. 2, in case the recording channel 22*c* is faulty as well as the recording channel 22*b*, the corresponding spare channels 24*c* and 24*b* whose resolution is 600 dpi are adjacent to each other. In this case, depending on the size of the ink droplet to be discharged, inks could be mixed up before fixing. A multi-beam exposure head could result in interference between coherent beams normally used.

Figure 5A:
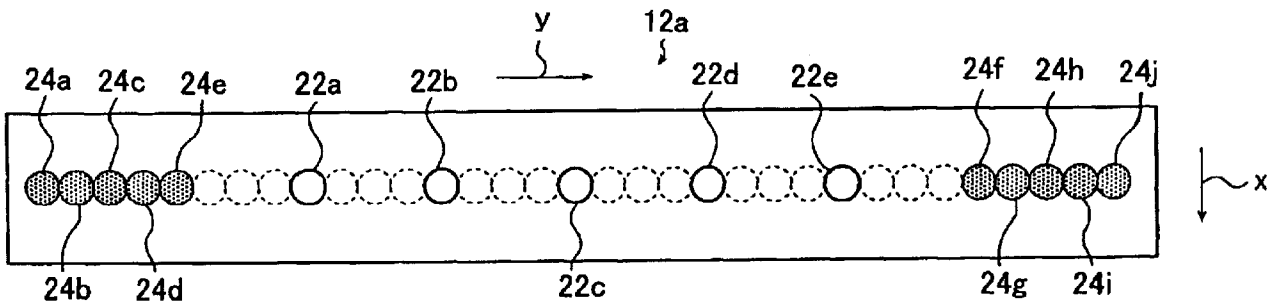
FIG. 5A is a conceptual illustration of another example of a recording head according to the invention.
Figure 5B:
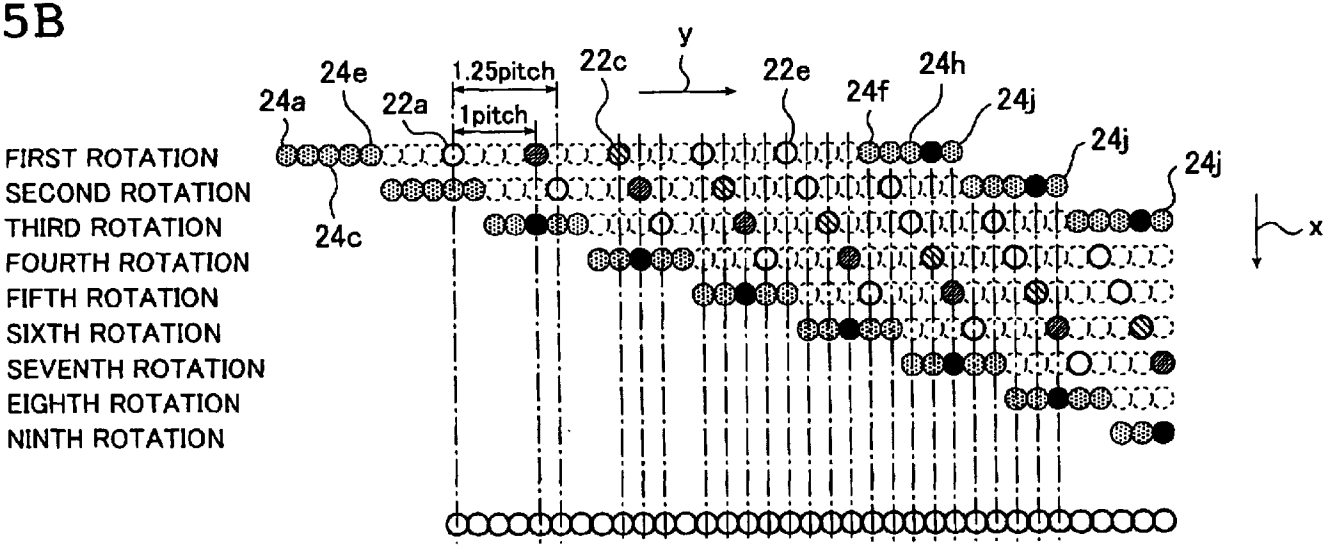
FIG. 5B is a conceptual illustration to explain interleave recording by using the recording head in FIG. 5A.

In order to offset such disadvantages, spare channels 24 may be formed on both sides of the recording channel 22, such as a recording head 12*a* shown in FIGS. 5A and 5B.

As mentioned earlier, for the left-hand spare channel 24, the spare channel 24*d* corresponds to the recording channel 22*a*, the spare channel 24*c* to the recording channel 22*b*, the spare channel 24*b* to the recording channel 22*c*, the spare channel 24*a* to the recording channel 22*d*, and the spare channel 24*e* to the recording channel 22*e*, with compensation performed respectively.

The recording head 12*a* further comprises the spare channel 24 on the right. As shown in FIG. 5, the spare channel 24*f* corresponds to the recording channel 22*a*, the spare channel 24*j* to the recording channel 22*b*, the spare channel 24*i* to the recording channel 22*c*, the spare channel 24*h* to the recording channel 22*d*, and the spare channel 24*g* to the recording channel 22*e*, with compensation performed respectively.

In this way, for example, even in case the recording channel 22*b* (dense hatch lines) and the recording channel 22*c* (coarse hatch lines) are faulty channels, the spare channel 24*c* (solidly shaded) is associated with the recording channel 22*b* and the spare channel 24*i* (solidly shaded) is associated with the recording channel 22*c* in order to avoid use of adjacent spare channels 24, same as the preceding example.

That is, by arranging spare channels on both sides of the recording channel, it is possible to assign corresponding spare channels right and left to avoid use of adjacent spare channels even in the presence of a plurality of faulty channels. This prevents a crosstalk between spare channels arranged based on the recording resolution and allows stable image recording.

The invention will be described in detail on the operation of the printer 10 shown in FIGS. 1 and 2.

On the printer 10, information on a faulty channel is previously input to the setting means 20. In the example shown, similar to the preceding, the recording channel 22*b* is a faulty channel as an example and the information is input to the setting means 20.

Accordingly, the setting means 20 sets the spare channel 24*c* and two rotations behind for the recording channel 22*b*. The spare channel 24 corresponding to each recording channel 22 and its number of rotations behind are uniquely determined as mentioned earlier, so that such information should be tabulated and possessed by the setting means 20.

In the invention, a method for detection of a faulty channel is not limited but various methods are available.

For example, a method may be used where a calibration chart is analyzed in calibration to detect streaked unevenness such as a whiteness clarity and the recording channel corresponding to the streaked unevenness is detected. A filled-in image may be recorded for detection of a faulty channel instead of a calibration chart in order to analyze the image and detect a faulty channel. A method is also preferable where helical scanning with large travel amount per rotation is used to record a helical structure on each recording channel instead of interleave recording and the helical structure is analyzed to detect a faulty channel.

A faulty channel may be input into the setting means 20 by an operator or an external inspection apparatus. Or, a scanner mounted on a printer may be used to read an image such as the aforementioned chart and the printer itself (for example the setting means 20) may analyze the image to determine a faulty channel.

Based on the above setting, the image data is supplied to the setting means 20.

The setting means 20 rearranges the supplied image data in accordance with the number of rotations of the drum 16 and the position of each recording channel 22 in the sub-scanning direction in each rotation and assigns the image data to each recording channel 22. The setting means 20 further rearranges the pixels so as to assign the image data on the recording channel 22*b* as a faulty channel in accordance with the number of rotations behind (two) of the spare channel 24*c* with respect to the recording channel 22*b*, and transmits the rearranged image data to the head unit 14 (its recording controller).

As mentioned earlier, the drum 16 rotates while holding the image receiving medium P. The head unit 14 moves in the sub-scanning direction at a predetermined travel pitch p, having the direction of the array of recording channels of the recording head 12 aligned with the direction of the sub-scanning (axis of the drum 16).

This causes the recording head 12 to perform helical scanning of the image receiving medium P. The head unit 14 modulates and drives each recording channel 22 of the recording head 12 in accordance with the supplied image data. An image is recorded at 600 dpi through interleave recording by the recording head 12 of 150 epi.

While the recording head, image recording method and image recording apparatus according to the invention have been detailed, the invention is not limited to the above embodiments. Various changes and modifications can be made in the invention without departing the spirit and scope thereof.

As detailed hereinabove, according to the invention, it is possible to perform image recording at a predetermined resolution without lowering the productivity and with a short halt period even in the presence of a faulty channel in the interleave recording to provide image recording at a higher resolution than the physical resolution of a recording head, by using a multi-channel recording head.

What is claimed is:

1. A multi-channel recording head the physical resolution of which is lower than the resolution of an image to be recorded, comprising:

a plurality of recording channels arranged in one direction; and spare channels arranged away from said recording channels by an integral multiple of the channel pitch of said recording channels on the extension of an array of said recording channels, said spare channels being arranged as least as many as the number of said recording channels, and each spare channel having the same physical resolution as the resolution of said image to be recorded.

2. The recording head according to claim 1, wherein said resolution of said image to be recorded is the dot resolution of said image to be recorded.

3. The recording head according to claim 1, wherein said spare channels are arranged on both ends of the array of said recording channels.

4. An image recording method of recording an image by using a recording head the physical resolution of which is lower than the resolution of the image to be recorded, said recording head comprising: a plurality of recording channels arranged in one direction; and spare channels arranged away from said recording channels by an integral multiple of the channel pitch of said recording channels on the extension of an array of said recording channels, said spare channels being arranged as least as many as the number of said recording channels, and each spare channel having the same physical resolution as the resolution of said image to be recorded, said image recording method comprising:

rotating a drum with a recording medium wrapped around the periphery of the drum;

moving said recording head in a direction of an axis of the drum while aligning a direction of the array of said recording channels of said recording head with the direction of the axis of the drum; and modulating each recording channel of said recording head in accordance with said image to be recorded, thereby performing image recording at a higher resolution than said physical resolution of said recording head, when a faulty channel exists among said recording channels, said image recording method further comprising:

previously determining a spare channel corresponding to the faulty channel among said recording channels;

assigning recording data on said fault channel to the corresponding spare channel in the image recording; and modulating said corresponding spare channel with said assigned recording data in accordance with the number of rotations of said corresponding spare channel behind said faulty channel in the image recording.

5. The image recording method according to claim 4, wherein said resolution of said image to be recorded is the dot resolution of said image to be recorded.

6. The image recording method according to claim 4, wherein said spare channels are arranged on both ends of the array of said recording channels.

7. The image recording method according to claim 4, wherein the ratio of travel amount of the recording head per rotation of said drum to the channel pitch of said recording channel is assumed as p, the ratio of the recording resolution to the physical resolution of said recording head as N, the number of recording channels of said recording head as M, and an arbitrary integer as X, N and M being integers and the following expressions (1) and (2) are satisfied:

$$p^{*}N=M \qquad \text{Expression (1)}$$

$$p=X+1/N \qquad \text{Expression (2).}$$

8. An image recording apparatus, comprising:

a recording head the physical resolution of which is lower than the resolution of the image to be recorded, said recording head comprising: a plurality of recording channels arranged in one direction; and spare channels arranged away from said recording channels by an integral multiple of the channel pitch of said recording channels on the extension of an array of said recording channels, said spare channels being arranged as least as many as the number of said recording channels, and each spare channel having the same physical resolution as the resolution of said image to be recorded;

a drum rotating with a recording medium wrapped around the periphery of the drum;

moving means for moving said recording head in the direction of the axis while aligning the direction of the array of the recording channels of said recording head with the direction of the axis of the drum;

determining means for acquiring the information on a faulty channel of said recording head and determining a spare channel corresponding to the faulty channel; and modulating means for modulating each recording channel of said recording head in accordance with the rotation of said drum and travel of said recording head, and when the faulty channel exists among said recording channels, assigning the recording data on said fault channel to the corresponding spare channel, and modulating said spare channel with said assigned recording data in accordance with the number of rotations of the spare channel behind the faulty channel, thereby performing image recording at a higher resolution than the physical resolution of said recording channel.

9. The image recording apparatus according to claim 8, wherein said resolution of said image to be recorded is the dot resolution of said image to be recorded.

10. The image recording apparatus according to claim 8, wherein said spare channels are arranged on both ends of the array of said recording channels.

11. The image recording apparatus according to claim 8, wherein the ratio of travel amount of the recording head per rotation of said drum to the channel pitch of said recording channel is assumed as p, the ratio of the recording resolution to the physical resolution of said recording head as N, the number of recording channels of said recording head as M, and an arbitrary integer as X, N and M being integers and the following expressions (1) and (2) are satisfied:

$$p^{*}N=M \qquad \text{Expression (1)}$$

$$p=X+1/N \qquad \text{Expression (2).}$$

* * * * *